US007197886B2

(12) United States Patent
Lesage et al.

(10) Patent No.: US 7,197,886 B2
(45) Date of Patent: Apr. 3, 2007

(54) HEAT RECLAIM REFRIGERATION SYSTEM AND METHOD

(76) Inventors: Gaétan Lesage, 817 Salaberry, Laval, QBC (CA) H7S 1H5; Jordan Kantchev, 1925 Guerin, Longueuil, QBC (CA) J4N 1J3

( * ) Notice: Subject to any disclaimer, the term of this patent is extended or adjusted under 35 U.S.C. 154(b) by 168 days.

(21) Appl. No.: 11/103,523

(22) Filed: Apr. 12, 2005

(65) Prior Publication Data

US 2006/0225458 A1 Oct. 12, 2006

(51) Int. Cl.
*F25B 5/00* (2006.01)

(52) U.S. Cl. ..... 62/117; 62/238.7; 62/510

(58) Field of Classification Search ..... 62/117, 62/196.4, 175, 238.6, 217, 238.7, 333, 510
See application file for complete search history.

(56) References Cited

U.S. PATENT DOCUMENTS 3,905,202 A * 9/1975 Taft et al. ..... 62/152
4,009,594 A 3/1977 Swanson
4,102,151 A 7/1978 Kramer et al.
4,167,102 A * 9/1979 Willitts ..... 62/152
4,279,129 A 7/1981 Cann et al.
4,285,205 A * 8/1981 Martin et al. ..... 62/113
4,318,277 A 3/1982 Cann et al.
4,535,603 A * 8/1985 Willitts et al. ..... 62/196.4
4,570,449 A * 2/1986 Knokey et al. ..... 62/183
4,602,485 A 7/1986 Fujimoto et al.
4,621,505 A * 11/1986 Ares et al. ..... 62/509
4,688,392 A 8/1987 Fujimoto et al.
4,711,094 A * 12/1987 Ares et al. ..... 62/90
4,914,926 A 4/1990 Gregory
4,949,551 A 8/1990 Gregory
5,050,400 A 9/1991 Lammert
5,056,327 A 10/1991 Lammert
5,065,584 A 11/1991 Byczynski et al.
5,179,841 A * 1/1993 Phillips et al. ..... 62/81
5,315,836 A 5/1994 Ressler
5,551,250 A 9/1996 Yingst et al.
5,575,158 A 11/1996 Vogel
5,586,444 A * 12/1996 Fung ..... 62/117
5,673,567 A * 10/1997 Dube ..... 62/117
5,845,509 A * 12/1998 Shaw et al. ..... 62/175
5,867,993 A 2/1999 Dube
5,887,440 A 3/1999 Dube
6,216,481 B1 * 4/2001 Kantchev ..... 62/238.7
6,286,322 B1 9/2001 Vogel et al.
6,502,412 B1 * 1/2003 Dube ..... 62/175
6,807,813 B1 10/2004 Lesage

FOREIGN PATENT DOCUMENTS

GB 2229804 A * 10/1990

* cited by examiner

*Primary Examiner*—Mohammad M. Ali
(74) *Attorney, Agent, or Firm*—Protections Equinox Int'l; Franz Bonsang, Patent Agent

(57) ABSTRACT

A heat reclaim refrigeration system uses a first compressor to elevate the amount of latent heat reclaimable by the system and to reclaim this heat using heat reclaim means, such as heat reclaim coils, for practical applications, such as heating a building. In addition, the system reduces pressure required from a second compressor used for refrigeration, and energy consumed thereby, especially during cold periods of the year when a refrigerant condensing means has lower condensing requirements.

19 Claims, 3 Drawing Sheets

HEAT RECLAIM REFRIGERATION SYSTEM AND METHOD

FIELD OF THE INVENTION

The present invention concerns refrigeration systems and methods, more particularly heat reclaim refrigeration systems and methods.

BACKGROUND OF THE INVENTION

Refrigeration systems are commonly used in supermarkets to refrigerate or to maintain in frozen state perishable products, such as foodstuff.

Conventionally, refrigeration systems include a network of refrigeration compressors and evaporators. Refrigeration compressors mechanically compress refrigerant vapor, which is circulated from the evaporators, to increase its temperature and pressure. The resulting high-temperature refrigerant vapor, under high-pressure, is circulated to a refrigerant condensing means where the latent heat from the vapors is absorbed. As a result, the refrigerant vapor liquefies into refrigerant liquid. The refrigerant liquid is circulated through refrigerant expansion valves, thereby reducing the temperature and pressure, to the evaporators wherein the refrigerant liquid evaporates by absorbing heat from the surrounding foodstuff.

In colder environments having temperatures similar to those found in, for example, the northern part of the United States or Canada during colder periods of the year, such as winter, the condensing pressure and temperature of the refrigerant in the refrigerant condenser means are subject of the surrounding ambient air temperature. Thus, the surrounding ambient air may serve to cool the refrigerant vapor, reducing the condensing pressure required from the compressors for condensing the refrigerant vapor. Indeed, it has been estimated that energy requirements for a given refrigeration capacity may be reduced on average by 30% in such colder environments or during such colder periods. Thus, it is entirely conceivable that, in such colder periods or environments, some compressors in a refrigeration system may be unused or operate at lower energy requirements, thus conserving energy.

However, low condensing pressure has negative impacts on some aspects of a typical refrigeration system. For example, low condensing pressure may result in refrigerant liquid having insufficient pressure to properly feed the refrigerant expansion valves. Further, in typical refrigeration systems, heat is given off, or rejected, by the refrigerant condensing means as the refrigerant vapor is cooled in the refrigerant condensing means. This heat is rejected latent heat from the refrigerant, generated by the system, which, unless reclaimed, becomes lost latent heat which, in turn, constitutes wasted energy, especially when the refrigerant condensing means is located outside, such as is typically the case for air-cooled refrigerant condenser means. This lost latent heat is particularly disadvantageous during colder periods or in colder environments, i.e. where lower condensing pressure may be used to reduce energy requirements for compressors, as it is desirable in such environments to conserve the latent heat for purposes of, among other things, comfort heating of a building in which the refrigeration system is located. It is possible to reduce the wasted energy by installing a heat reclaim means to reclaim the rejected latent heat, as it is given off by the condenser, thus reducing loss of the latent heat. However, low condensing pressure can result in low condensing temperature of refrigerant vapor. In such circumstances, latent heat released upon heat reclaim will be at the low condensing temperature, which may be insufficient for use of the heat for any useful purpose.

In addition, low condensation pressure generated in compressors may also have negative impacts on system defrost capabilities. For example, many refrigeration systems use the so-called hot refrigerant gas defrost method wherein hot refrigerant gas is re-routed backward from the compressors, where it is converted to refrigerant liquid, thereby giving off heat that defrosts the evaporator. However, low condensing pressure may result in the refrigerant being insufficiently pressurized to circulate thereafter to either the condenser means or the evaporators for subsequent usage thereby.

Accordingly, it would be advantageous to have a refrigeration system that allows for use of lower condensing pressure while providing sufficient heat reclaim of rejected latent heat for useful purposes, such as comfort heating, and maintaining efficient defrost cycles.

SUMMARY OF THE INVENTION

The present invention provides a heat reclaim refrigeration system that, advantageously, permits improved reclaim of latent heat generated during the refrigeration cycle, thereby conserving energy and allowing the heat to be used for, among other things, comfort heating of a building. Advantageously, the system allows for variable pressure levels in the compressors, thus permitting compressors to use less energy when less condensing pressure is required for condensing refrigerant vapor in a refrigerant condensing means, such as when the condenser is situated in a colder environment. Further, the system also provides for efficient defrost of evaporators.

In a first aspect of the present invention, therein is provided a refrigeration heat reclaim system including at least one evaporator for evaporating a refrigerant from a refrigerant liquid into a refrigerant vapor, thereby providing refrigeration during a refrigeration cycle. The system comprises:

a first compressor engageable in a heat reclaim cycle, the first compressor being operatively connected to the evaporator for receiving the refrigerant vapor therefrom and compressing the refrigerant vapor received to a first pressure level, the refrigerant vapor being discharged from the first compressor through a first discharge outlet line connected thereto;

a second compressor engageable in the refrigeration cycle, the second compressor being operatively connected to the evaporator for receiving the refrigerant vapor therefrom and for compressing the refrigerant vapor received to a second pressure level, the refrigerant vapor being discharged from the second compressor through a second discharge outlet line connected thereto for subsequent condensing into the refrigerant liquid; and a heat reclaim means having at least one heat reclaim inlet line connected to the first discharge outlet line for absorbing latent heat from the refrigerant vapor discharged therein during the heat reclaim cycle, thereby reclaiming the latent heat, wherein the first pressure level is greater than the second pressure level, the refrigerant vapor at the first pressure level having an increased evaporating temperature which increases the latent heat reclaimable therefrom by the heat reclaim means.

In a second aspect of the present invention, therein is provided a method for heat reclaim in a refrigeration system having a first compressor, a second compressor, and a heat reclaim means, the method comprising the steps of:

a) during a heat reclaim cycle for the first compressor, compressing a refrigerant vapor in the first compressor to a first pressure level and in the second compressor to a second pressure level, wherein the first pressure level is greater than the second pressure level, the refrigerant vapor at the first pressure level thereby having an increased evaporating temperature for providing an increased an amount of latent heat reclaimable from the refrigerant vapor by the heat reclaim means;

b) after the compressing, circulating the refrigerant vapor at the first pressure level to the heat reclaim means; and c) after the circulating, condensing the refrigerant vapor at first pressure level into a refrigerant liquid, thus releasing the increased amount of the latent heat which is absorbed by the heat reclaim means, thereby providing heat reclaim.

BRIEF DESCRIPTION OF THE FIGURES

Further aspects and advantages of the present invention will become better understood with reference to the description, provided for purposes of illustration only, in association with the following figures, wherein.

DETAILED DESCRIPTION OF THE PREFERRED EMBODIMENTS

Figure 1:
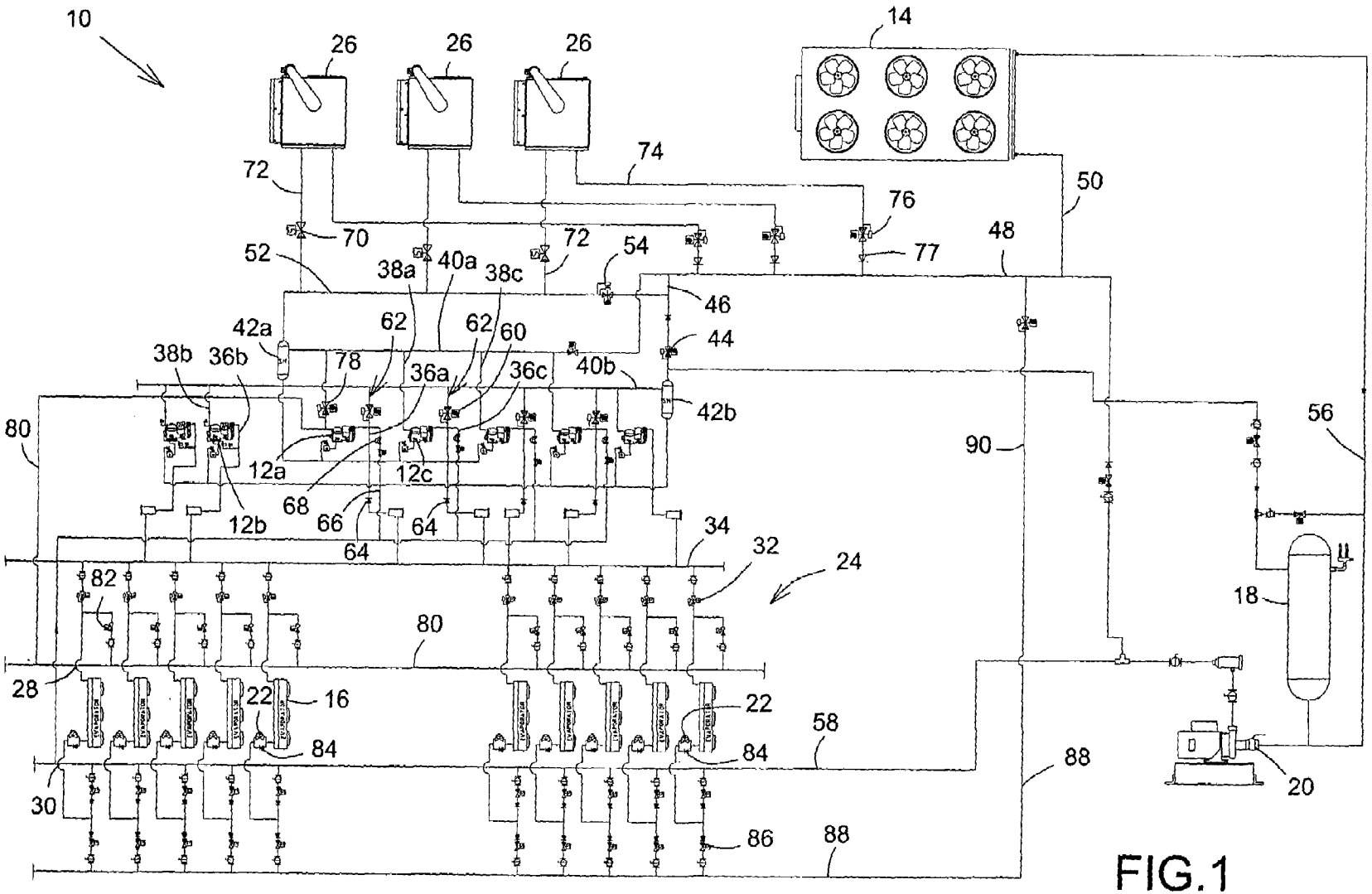
FIG. 1 is a schematic diagram of a heat reclaim refrigeration system having an outdoor air-cooled condenser as refrigerant condensing means and air-to-refrigerant heat reclaim coils as a heat reclaim means, in accordance with a first embodiment of the present invention.

Reference is now made FIG. 1, a schematic diagram of a heat reclaim refrigeration system, shown generally as 10, having an outdoor air-cooled condenser as refrigerant condensing means and air-to-refrigerant heat reclaim coils as a heat reclaim means, in accordance with a first embodiment of the present invention. Broadly speaking, the system 10 includes two or more compressors 12, an outdoor air-cooled condenser 14 as a refrigerant condensing means, evaporators 16, a refrigerant liquid receiver 18, a refrigerant liquid pump 20, one or more refrigerant expansion valves 22, and a network, shown generally as 24. The network 24 includes a variety of conduits, also referred to as passageways or lines, valves and manifolds, through which the refrigerant liquid pump 20, the evaporators 16, the compressors 12, and the air-cooled condenser 14 are interconnected to circulate the refrigerant. In the embodiment, heat reclaim means, namely refrigerant-to-air heat reclaim coils 26, are also connected to network 24 for reclaiming, during heat reclaim cycles, latent heat generated and rejected by the system 10. System 10 is capable of generating variable levels of pressure for the refrigerant, used for providing refrigeration, and the refrigerant may very between states as a refrigerant liquid and a refrigerant vapor.

In the embodiment, the two or more compressors include one first compressor 12*a* that engages in the heat reclaim cycle and defrost cycle when required, as well as refrigeration cycles, and one second compressor 12*b* that may only engage in the refrigerating cycle. Optional compressor 12*c* may be engaged for refrigeration cycles and heat reclaim cycles, but not defrost cycles. For purposes of brevity, the heat reclaim cycle, refrigeration cycle, and defrost cycle are described primarily with reference to compressors 12*a*, 12*b*. However, since the function of compressor 12*c*, with the exception of defrost cycles, is identical to compressor 12*a*, a brief explanation of compressor 12*c*, by analogy to compressor 12*a* is also included.

When engaged in the refrigeration cycle, compressor 12 compresses refrigerant as low-pressure refrigerant vapor is received thereby from evaporators 16. Each evaporator 16 includes evaporator refrigerant vapor line 28 and evaporator refrigerant liquid line 30. Evaporator refrigerant vapor line 28 circulates the low-pressure refrigerant vapors through an evaporator pressure-regulating valve 32 into suction manifold 34. Each compressor 12 has at least one suction inlet line 36, connected to suction manifold 34, and at least one discharge outlet line 38. Specifically, suction inlet line 36*a* of compressor 12*a* connects compressor 12*a* to the suction manifold 34, whereas suction inlet line 36*b* of compressor 12*b* connects compressor 12*b* to suction manifold 34. In addition, suction inlet line 36*c* of compressor 12*c* connects compressor 12*c* to suction manifold 34. Thus, compressor 12 is operatively connected to evaporator 16 through suction manifold 34 and suction inlet line 36.

Suction inlet line 36 receives the low-pressure refrigerant vapor from suction manifold 34 and compressor 12 compresses the low-pressure refrigerant vapor, thereby increasing its pressure and temperature, to produce high-temperature, high-pressure refrigerant vapor. Once the refrigerant vapor is so compressed, it is circulated from the compressor 12 through discharge outlet line 38 to discharge outlet manifolds 40, and then to oil separator 42, which reduce the amount of oil from compressor 12 that may have become mixed with the refrigerant vapors during compression in the compressor 12. Specifically, compressor 12*a* discharges the refrigerant vapor through first discharge outlet line 38*a* into first discharge outlet manifold 40*a*, and then through first oil separator 42*a*. Compressor 12*c* also discharges refrigerant vapor into first discharge outlet manifold 40*a*, and then through first oil separator 42 via third discharge outlet line 38*c* connected to first discharge outlet manifold 40*a*. Compressor 12*b* discharges refrigerant vapor through second discharge outlet line 38*b* into second discharge outlet manifold 40*b*, and then through second oil separator 42*b*.

In colder environments having temperatures similar to those found in the northern part of the United States or Canada during colder periods of the year, pressure and temperature of refrigerant vapor discharged from compressors 12 engaged in refrigeration cycle, while still high compared to entry of refrigerant into compressors 12, are reduced, due to colder ambient air temperature for air-cooled condenser 14, compared to warmer environments. Refrigerant condensing means, i.e. air-cooled condenser 14 in the first embodiment, can thus function with a lower condensing pressure, i.e. the pressure required from compressors 12 to cause the refrigerant to condense in the refrigerant condensing means for use in the refrigeration cycle, to take advantage of the lower ambient air temperature. Therefore, less compressing is required of compressors 12, thereby reducing energy requirements thereof. In other words, while refrigerant vapor remains at high-temperature and high-pressure in colder environments, the temperature and pressure thereof is nonetheless comparatively lower than in warmer environments having warmer temperatures.

During the refrigeration cycle, once the high-pressure refrigerant vapor has passed through the oil separator 42, it is transferred to refrigerant condensing means, i.e. outdoor air-cooled condenser 14 in the embodiment. Specifically, for compressor 12*b*, the high-pressure refrigerant vapor passes through refrigerant pressure-regulating valve 44 and then condenser refrigerant inlet lines 46, 48 and 50, respectively, to the outdoor air-cooled condenser 14. For compressor 12*a* and compressor 12*c* the high-pressure refrigerant vapor passes through conduit 52 to a double set point pressure-regulating valve 54 and then through refrigerant condenser inlet lines 46, 48, and 50, respectively, to outdoor air-cooled condenser 14. Thus, discharge outlet line 38, and therefor compressor 12, are operatively connected to refrigerant condenser means. Double set pressure-regulating valve 54, set at a second setting when compressors 12*a*, 12*c* engage in refrigeration cycles, regulates pressure in conduit 52, first discharge outlet manifold 40*a*, and discharge outlet lines 38*a*, 38*c* to substantially the same level as in second discharge outlet manifold 40*b* and second discharge outlet line 38*b*. Thus, the pressure level of refrigerant circulated from all compressors 12 engaged in the refrigeration cycle to refrigerant condensing means is substantially the same.

Referring still to FIG. 1, outdoor air-cooled condenser 14 condenses the high-temperature, high-pressure refrigerant vapor, thus producing high-pressure refrigerant liquid that circulates through refrigerant condenser outlet line 56 to refrigerant liquid receiver 18. Refrigerant liquid pump 20 then circulates the refrigerant liquid through refrigerant liquid manifold 58 to which each evaporator 16 is connected via the evaporator's 16 respective refrigerant liquid line 30. Next, the refrigerant liquid circulates through a refrigerant expansion valve 22 disposed in the refrigerant liquid line 30 of evaporator 16. The refrigerant expansion valve 22 expands the refrigerant liquid, which absorbs heat from material, such as foodstuff or the like, surrounding evaporator 16 and evaporates into refrigerant vapor. The refrigerant vapor then circulates from evaporator 16, via evaporator refrigerant vapor line 28, into suction manifold 34, where it is circulated, via suction inlet line 36, into compressor 12 using suction generated thereby.

When a heat reclaim cycle is initiated, a heat reclaim signal from a refrigeration control system (not shown) causes compressor 12*a* to engage in the heat reclaim cycle. Compressor 12*b* continues, as required, to perform refrigeration compression as described above for the refrigeration cycle.

When the heat reclaim signal is received, the double set point pressure-regulating valve 54 is automatically set to a first setting for maintaining a first, higher pressure level in first discharge outlet manifold 40*a* for compressor 12*a* engaging in the heat reclaim cycle, compared with a second, lower pressure level in second discharge outlet manifold 40*b* for compressor 12*b* engaged in the refrigeration cycle. The second pressure level is the level to which refrigerant liquid discharged from any compressor 12 engaged in the refrigeration cycle must be compressed. As condensing of refrigerant vapor in refrigerant condenser means is one of the principal uses for pressure generated by compressors 12 engaged in the refrigeration cycle, the second pressure level is substantially defined by, and varies with, the condensing pressure required. The second pressure level could be as low as 120 PSIG for R-22 in the winter months, since the ambient outdoor temperature will facilitate will facilitate condensation of refrigerant vapor in the refrigerant condensing means, thus reducing condensing pressure requirements for the refrigeration cycle. Refrigerant vapor from compressor 12*a* at first pressure level has an increased, i.e. raised, evaporating temperature which increases the amount of latent heat storable and carriable by the refrigerant vapor at first pressure level. In the embodiment, the first pressure level is attained by raising suction pressure in suction inlet line 36*a* of compressor to a level corresponding to +45 degrees Fahrenheit (+45° F.) evaporating temperature, i.e. the increased evaporating temperature. However, as will be apparent to one skilled in the art, other evaporating temperatures may be chosen depending on requirements. It is not the intention of the inventor to limit the evaporating temperature for refrigerant at the first pressure level to a specific temperature mentioned herein.

Concurrently with setting of double-set pressure-regulating valve to the first pressure level for the heat reclaim cycle, bypass passageway pressure-regulating valve 60 is engaged (e.g. opened) in bypass passageway, shown generally as 62, that is connected to first suction inlet line 36*a* of compressor 12*a*, and second discharge outlet manifold 40*b*. Thus, second discharge outlet line 38*b* of compressor 12*b*, engaged in the refrigeration cycle, is operatively connected to compressor 12*a* via first suction inlet line 36*a*. The bypass passageway pressure-regulating valve 60 causes refrigerant vapor at second pressure level from compressor 12*b* engaged in the refrigeration cycle to circulate from second discharge manifold 40*b* into first suction inlet line 36*a* of compressor 12*a* along bypass passageway 62. Thus, the refrigerant vapor, already compressed to high temperature and high pressure at the second pressure level, circulated into bypass passageway 62 is compressed again by compressor 12*a* to reach the first pressure level. It is this circulating of the high temperature refrigerant vapor at second pressure level from second discharge manifold 40*b* into compressor 12*a* for further compression that results in the raised, increased evaporating temperature of the refrigerant vapor at the first pressure level. At the same time, since the refrigerant vapor at second pressure level recirculated to compressor 12*a* has already been partially compressed towards the first pressure level, the amount of compression performed by compressor 12*a* may be reduced, thus reducing energy requirements thereof. To further facilitate compressing to first level, a bypass passageway check valve 64 that is in in-series connection with bypass passageway pressure-regulating valve 60 closes to stop refrigerant vapor below the second pressure from feeding level from evaporator refrigerant vapor line 28 into suction inlet line 36*a* of compressor 12*a*. As a result of these measures, suction pressure in first suction inlet line 36*a* of compressor 12*a* is increased to a level corresponding to +45° F. evaporating temperature for raising refrigerant vapor to the first pressure level.

In order to maintain safe and stable suction temperature, refrigerant liquid from evaporator refrigerant liquid line 30 passes into suction manifold 34, via bypass passageway refrigerant liquid conduit 66, to a bypass passageway expansion valve 68 situated between refrigerant liquid line 30 and the first suction inlet line 36*a* for compressor 12*a*. The bypass passageway expansion valve 68 is a so-called desuperheating expansion valve and allows refrigerant liquid to mix with high-temperature, high-pressure refrigerant vapor. Thus, the temperature is stabilized and maintained at an acceptable level at first suction inlet line 36*a* for compressor 12*a* engaged in the heat reclaim cycle.

In the first embodiment, refrigerant vapor at the first pressure level from discharge manifold 40*a* is circulated through heat reclaim solenoid valves 70, housed in heat reclaim inlet lines 72, to the heat reclaim means, i.e. the refrigerant-to-air heat reclaim coils 26. Each refrigerant-to-air heat reclaim coil 26 has a heat reclaim inlet line 72 connected to first discharge manifold 40*a*, with each heat inlet line 72 having a heat reclaim solenoid valve 70. In the refrigerant-to-air heat reclaim coil 26, latent heat from the high-pressure, high-temperature refrigerant vapor is exposed to cool air. The cool air causes the latent heat to be released into heat reclaim coils 26, from where it is absorbed by the cool air. Thus, the cool air is heated into circulatable heated air, thereby reclaiming the latent heat which may then be circulated around a building to provide comfort heating thereof. Each refrigerant-to-air heat reclaim coil 26 has a heat reclaim outlet line 74 with heat reclaim check valve 77 and heat reclaim pressure-regulating valve 76 disposed therein. The absorption of latent heat from the refrigerant vapor at least partially converts the refrigerant vapor, via condensation, to refrigerant liquid. Thus, after passing through the refrigerant-to-air heat reclaim coil 26, refrigerant, whether refrigerant liquid or refrigerant vapor, exits through the heat reclaim pressure-regulating valve 76 located in the heat reclaim outlet line 74. The heat reclaim outlet line 74 circulates the refrigerant into conduit 48 where it is passed to the refrigerant condensing means, i.e. the outdoor air-cooled condenser 14 in the first embodiment. Thus, the refrigerant condensing means is operatively connected to the heat reclaim means. The refrigerant liquid then passes to evaporator 16, and then to the suction manifold 34, as described previously for the refrigeration cycle.

During the heat reclaim cycle, the resulting increased evaporating temperature of +45° F. for the refrigerant vapor at the first pressure elevates the amount of latent heat that may be carried and stored by the refrigerant vapor. Consequently, this additional latent heat, at least compared to refrigerant vapor at second pressure level, can be reclaimed during the heat reclaim cycle, thus increasing heat reclaimed and efficiency. At the same time, the further compressing of the refrigerant vapor at the second pressure level to reach the first pressure level ensures that at least a portion of the latent heat in the refrigerant from compressor 12*b*, in addition to that from compressor 12*a*, is also reclaimed. This portion can vary from a minimal or nil amount of the latent heat for environments having very warm ambient air temperatures to the totality of the latent heat in colder environments. The relatively lower temperature heat of compressor 12*b*, operating at comparatively lower second pressure level and used for refrigeration, is thus transformed very efficiently by compressor 12*a* during the heat reclaim cycle into high-temperature value heat usable for comfort heating. Further, the lower second pressure level at which compressor 12*b* functions at all times allows compressor 12*b* to function with increased energy efficiency, especially in colder environments. In addition, the flow of refrigerant liquid to the air-cooled condenser 14 from the refrigerant-to-air heat reclaim 26 provides an amount of liquid refrigerant, already condensed, to the refrigerant condensing means. The amount of refrigerant vapor that must be condensed therein is therefor reduced, thus further reducing the condensing pressure required for, and energy consumed by, compressor 12*b* engaged in the refrigeration cycle. Therefore, the use of the bypass passageway 62 to circulate refrigerant vapor compressed in compressor 12*b* for further compression in compressor 12*a*, in combination with maintenance of higher pressure and increased evaporating temperature for refrigerant vapor at the first pressure level compressed in compressor 12*a*, provides greater heat reclaim in heat reclaim means while still allowing for lower pressure of refrigerant vapor discharged by compressor 12*b*, and less energy use thereby, engaged in the refrigeration cycle.

As mentioned previously, compressor 12*c* may also engage in heat reclaim cycles and refrigeration cycles. Compressor 12*c*, via suction inlet line 36*c*, is operatively connected, by bypass passageway 62, to second discharge outlet line 38*b* and second discharge manifold 40*b* during the heat reclaim cycle in exactly the same fashion as is compressor 12*a* and first suction inlet line 36*c*. Further, compressor 12*c* is connected to first discharge manifold 40*a* and conduit 52 by discharge outlet line 38*a*. Thus, compressor 12*c* is also operatively connected to heat reclaim means and refrigerant condensing means and functions in the same way as compressor 12*a* during heat reclaim cycles and refrigeration cycles. However, unlike compressor 12*a*, compressor 12*c* does not engage in defrost cycles.

During a defrost cycle, compressor 12*a* is engaged to defrost evaporator 16. The defrost cycle is engaged when compressor 12*a* receives a defrost signal from a refrigeration system controller. The defrost signal may be received when compressor 12*a* is in either the refrigeration cycle or heat reclaim cycle. Similarly, when the defrost cycle is terminated, compressor 12*a* may return to either the heat reclaim cycle or the refrigeration cycle.

In the embodiment, the hot gas refrigerant method is used for the defrost cycle. An efficient implementation of this method and a system making use thereof, conceived by the inventor, is the subject of U.S. Pat. No. 6,807,813, to which the reader is referred to facilitate comprehension. When compressor 12*a* is engaged in the defrost cycle refrigerant vapor at second pressure level from discharge manifold 40*b* is rerouted, using the bypass passageway 62, and further compressed to the first pressure level by compressor 12*a* as described above for the heat reclaim cycle, and available refrigerant vapor mass. Again, as in the heat reclaim cycle, the bypass passageway expansion valve 62 is used to regulate the suction temperature and the double set point pressure-regulating valve 54 is set to the first setting. However, unlike the heat reclaim cycle, defrost pressure-regulating valve 78 is engaged and causes refrigerant vapor at the first pressure level to flow from first discharge outlet line 38*a* through refrigerant vapor defrost manifold 80 and into evaporator 16. The refrigerant vapor circulates from refrigerant defrost manifold 80 through the evaporator refrigerant vapor line 28 into the frosted evaporator 16 via defrost solenoid valve 82. Thus, first discharge outlet line 38*a* and evaporator 16 are operatively connected during the defrost cycle.

As the refrigerant vapor circulates through the frosted evaporator 16, the refrigerant vapor condenses into refrigerant liquid, thus giving off heat that defrosts the evaporator 16. The refrigerant liquid then exits the evaporator 16 through a defrost check valve 84 disposed in the evaporator refrigerant liquid line 30 and passes, via defrost refrigerant liquid solenoid valve 86, into a refrigerant liquid return manifold 88. From refrigerant liquid return manifold 88, the refrigerant liquid circulates into refrigerant liquid return inlet line 50. Refrigerant liquid return inlet line 50 is operatively connected to at least one of refrigerant condenser inlet line 48 and refrigerant condenser inlet line 50 and refrigerant liquid can thus circulate therefrom into refrigerant condenser means, i.e. air-cooled condenser 14 in the embodiment. After reaching the air-cooled condenser 14, the refrigerant liquid is circulated along to refrigerant liquid receiver 18 and evaporator 16 as described for the refrigeration cycle described above. As the refrigerant from the refrigerant liquid return inlet line 90 is already condensed into liquid form, the amount of refrigerant to be condensed by the air-cooled condenser 14 is reduced, thus reducing the condensing pressure required to be generated by compressor 12*b* engaged in the refrigeration cycle. Energy efficiency of compressor 12*b*, 12*c* and of refrigerant condensing means is therefore increased, even when the surrounding ambient temperatures are hot. When refrigerant condensing means is located in a colder environment, the additional cooling of the refrigerant liquid from the refrigerant liquid return inlet line 90 allows the refrigerant condensing means, i.e. air-cooled condenser 14 condenser in the embodiment, to function with even lower condensing pressure.

Figure 2:
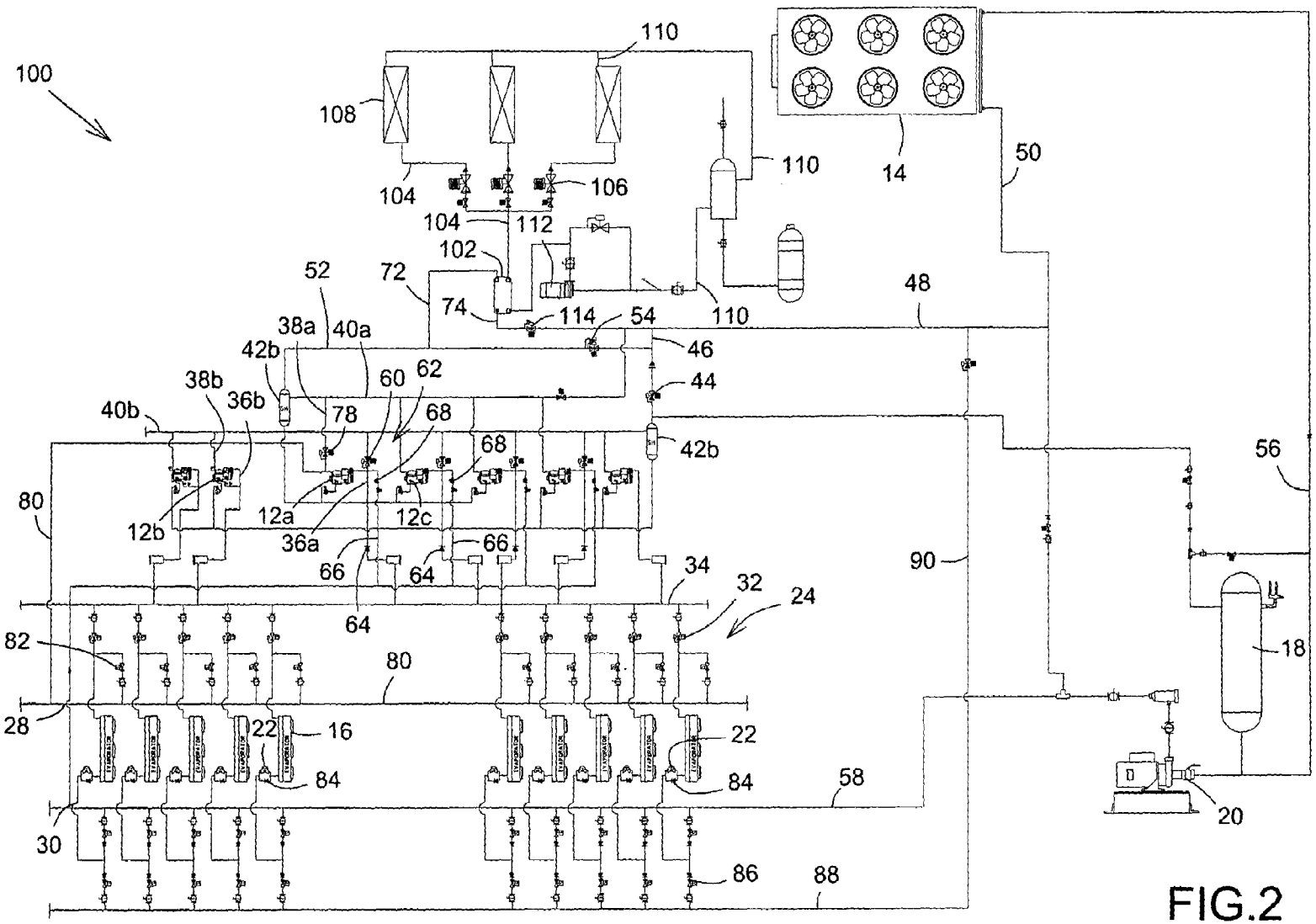
FIG. 2 is a schematic diagram of a heat reclaim refrigeration system having an outdoor air-cooled condenser as refrigerant condensing means and water-to-air heat reclaim coils, in conjunction with an indoor water-cooled condenser, as a heat reclaim means, in accordance with a second embodiment of the present invention.

Turning now to FIG. 2, therein is shown is a schematic diagram of a heat reclaim refrigeration system, shown generally as 100, having an outdoor air-cooled condenser as refrigerant condensing means and water-to-air heat reclaim coils, in conjunction with an indoor water-cooled condenser, as a heat reclaim means, in accordance with a second embodiment of the present invention. The second embodiment functions in the essentially the same fashion as the first embodiment. However, instead of feeding refrigerant vapor at the first pressure level from compressor 12*a*, 12*c* directly to the refrigerant-to-air heat reclaim coils, the refrigerant vapor is circulated into an indoor water-cooled condenser 102.

Specifically, in the second embodiment, refrigerant vapor at first pressure level is initially generated during the heat reclaim cycle using compressor 12*a*, 12*c* and circulated to first discharge manifold 40*a* and then conduit 52 in the same manner as in the first embodiment. However, unlike the first embodiment, once the refrigerant vapor is circulated into heat reclaim inlet line 72, it is circulated into an indoor water-cooled condenser 102. Cool water contained in the water-cooled condenser 102 causes the refrigerant vapor to give off latent heat which is absorbed by the cool water. The cool water is thus transformed into heated water. The heated water is then circulated through a closed loop system from the water-cooled condenser 102 into water heat reclaim inlet lines 104, passing through water heat reclaim solenoid valves 106 disposed therein, to water-to-air heat reclaim coils 108. The heat reclaim coils 108 are exposed to cool air that is cooler than the heated water. The cool air causes the heated water to give off heat, i.e. the latent heat absorbed in the water-cooled condenser 102, which is absorbed by the water-to-air heat reclaim coils 108. The cool air then absorbs the latent heat from the water-to-air heat reclaim coils 108 and is heated thereby into heated air that may be circulated for comfort heating or other useful purposes. At the same time, as the heated water gives off the latent heat, absorbed by water-to-air heat reclaim coils 108, the water is again cooled into cool water. The cool water exits the water-to-air heat reclaim coils 108 through water heat reclaim outlet line 110 and is transferred to water pump 112 where the water is again pumped into the water-cooled condenser 102 for re-use and additional heat reclaim.

As the refrigerant vapor passes through the water-cooled condenser 102, it is at least partially converted to refrigerant liquid that is circulated through refrigerant heat reclaim outlet line 74. Water-cooled condenser refrigerant pressure-regulating valve 114 disposed in refrigerant heat reclaim outlet line 74 maintains refrigerant, as condensed refrigerant liquid, within the water-cooled condenser 102 at adequate pressure to ensure that the refrigerant carries enough latent heat to heat the water to the desired water temperature for subsequent absorption of the latent heat from the water in the water-to-air heat reclaim coils. Once refrigerant circulates through refrigerant heat reclaim outlet line 74, it circulates therefrom through conduits 48, 50. The refrigerant is then circulated to outdoor air-cooled condenser 14 and the rest of the heat reclaim cycle proceeds as in the first embodiment, providing similar condenser pressure and energy efficiency benefits.

As in the first embodiment, compressor 12*a* may engage in defrost cycles and refrigeration cycles and functions in substantially the same manner as compressor 12*a* for those cycles in the first embodiment. Further, compressor 12*b* is again dedicated to refrigeration cycles only and functions in the same fashion therefor as in the first embodiment. Compressor 12*c* also performs refrigeration cycles in the same manner as in the first embodiment and, also as in the first embodiment, does not provide defrost cycles.

Figure 3:
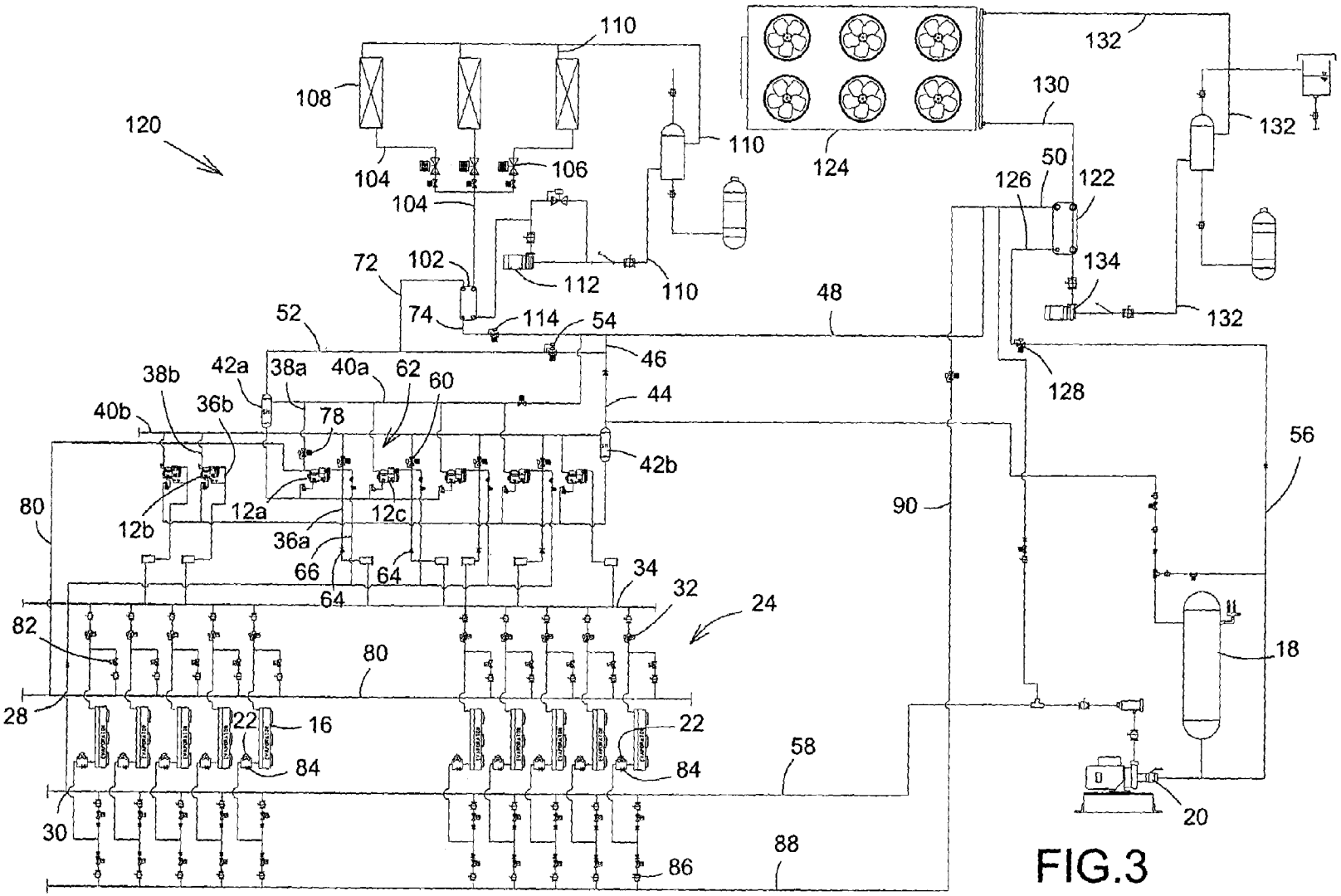
FIG. 3 is a heat reclaim refrigeration system having an indoor glycol-cooled condenser as refrigerant condenser means and water-to-air heat reclaim coils, in conjunction with an indoor water-cooled condenser, as a heat reclaim means, in accordance with a third embodiment of the present invention.

Turning now to FIG. 3, therein is shown a heat reclaim refrigeration system, shown generally as 120, having an indoor glycol-cooled condenser 122 as refrigerant condenser means and water-to-air heat reclaim coils 108, in conjunction with an indoor water-cooled condenser 102, as a heat reclaim means, in accordance with a third embodiment of the present invention. The heat reclaim cycle uses water-cooled condenser 102 and water-to-air heat reclaim coils 108 as heat reclaim means, just as in the second embodiment. However, the outdoor air-cooled condenser 14 is replaced with an indoor glycol-cooled condenser 122 and an outdoor air-cooled glycol cooler 124. Thus, the refrigeration cycle, heat reclaim cycle and defrost cycle are identical to those of the second embodiment, with the exception of the handling of the refrigerant by the refrigerant condenser means, i.e. the glycol-cooled condenser 122 and outdoor air-cooled glycol cooler 124.

The refrigerant, whether as refrigerant vapor or as refrigerant liquid, circulates from conduit 48, 50 into the glycol-cooled condenser 122. The refrigerant is condensed therein into refrigerant liquid, if not already in liquid form, as cooled glycol in the glycol-cooled condenser 122 absorbs latent heat of the refrigerant. The cooled glycol is thus heated into heated glycol. The refrigerant liquid is then circulated through glycol-cooled refrigerant outlet line 126. A glycol-cooled refrigerant pressure-regulating valve 128 disposed in glycol-cooled refrigerant outlet line 126 maintains the desired minimum condensing pressure of refrigerant liquid in the glycol-cooled condenser 122. The refrigerant liquid is then passed to the refrigerant liquid receiver 18 and evaporator 16 and the rest of the refrigeration cycle proceeds as in the first and second embodiments, providing the same condenser pressure and energy efficiency benefits. The defrost cycle is also substantially identical.

Glycol circulates through the glycol-cooled condenser 122 in a closed-loop system. Specifically, heated glycol circulates from glycol-cooled condenser 122 into air-cooled glycol cooler 124 via glycol inlet line 130. Heated glycol then passes through the air-cooled glycol cooler 124 where cool air absorbs heat from the heated glycol, thus cooling the heated glycol into cooled glycol. The cooled glycol then circulates through glycol outlet line 132 to glycol pump 124 disposed along glycol outlet line 132. Glycol pump 124 pumps cooled glycol back to glycol-cooled condenser 122 to be used again for condensing the refrigerant.

As in the first embodiment, compressor 12*a* may engage in defrost cycles and refrigeration cycles and functions in exactly the same fashion as compressor 12*a* for those cycles.

Further, compressor 12*b* is dedicated to refrigeration cycles only and functions in the same fashion therefor as in the first embodiment. Compressor 12*c* also performs refrigeration cycles in the same manner as in the first embodiment and, also as in the first embodiment, does not provide defrost cycles.

As one skilled in the art will realize, other types of condensers and heat reclaim technologies may be used as refrigerant condenser means and heat reclaim means. It is not the intention of the inventor to limit the scope of the invention to those condensers and heat reclaim coils described specifically herein.

Similarly, it is not the intention of the inventor to limit the scope of the invention to the specific configurations of components described herein. For example, a different number of compressors 12*a*, 12*b*, 12*c* could be used. Further, it will be apparent to one skilled in the art that heat reclaimed may be used for purposes other than for comfort heating, such as, for example, heating water. In addition, while the embodiments described herein are appropriate for grocery-store refrigeration, it is by no means the intention of the inventor to so limit the application of the invention.

Finally, it will be apparent to one skilled in the art that other embodiments of the present invention may be envisaged. The description provided herein is provided for purposes of illustration and not limitation. While a specific embodiment has been described, those skilled in the art will recognize many alterations that could be made within the spirit of the invention, which is defined solely according to the following claims.

We claim:

1. A refrigeration heat reclaim system including at least one evaporator for evaporating a refrigerant from a refrigerant liquid into a refrigerant vapor, thereby providing refrigeration during a refrigeration cycle, said system comprising:

a first compressor engageable in a heat reclaim cycle, said first compressor being operatively connected to the evaporator for receiving the refrigerant vapor therefrom and, during said heat reclaim cycle, compressing the refrigerant vapor received to a first pressure level, the refrigerant vapor being discharged from said first compressor through a first discharge outlet line connected thereto;

a second compressor engageable in the refrigeration cycle, said second compressor being operatively connected to the evaporator for receiving the refrigerant vapor therefrom and for compressing the refrigerant vapor received to a second pressure level, the refrigerant vapor being discharged from said second compressor through a second discharge outlet line connected thereto for subsequent condensing into the refrigerant liquid; and a heat reclaim means having at least one heat reclaim inlet line operatively connected to said first discharge outlet line for absorbing latent heat from the refrigerant vapor discharged therein during said heat reclaim cycle, thereby reclaiming said latent heat, wherein said first pressure level is greater than said second pressure level, the refrigerant vapor at said first pressure level having an increased evaporating temperature for increasing said latent heat reclaimable therefrom by said heat reclaim means.

2. The system of claim 1 wherein, when said first compressor is engaged in said heat reclaim cycle, said second compressor continues to be engageable in the refrigeration cycle, thereby providing said system with a simultaneous execution of the refrigeration cycle and said heat reclaim cycle.

3. The system of claim 1 wherein said first compressor is further engageable in the refrigeration cycle and, when engaged in the refrigeration cycle, compresses the refrigerant vapor to said second pressure level, the refrigerant vapor being discharged from said first compressor through said first discharge outlet line.

4. The system of claim 1, wherein, during said heat reclaim cycle, said second discharge outlet line is operatively connected to said first compressor for transmitting at least a portion of the refrigerant vapor compressed by said second compressor to said first compressor for further compressing to said first pressure level for reclaim of said latent heat from said portion thereby reducing wastage of said latent heat for said portion and facilitating compression to said first pressure level, said latent heat from said portion further heating the refrigerant vapor during said further compressing to said first pressure and thereby providing said increased evaporating temperature.

5. The system of claim 1, wherein said heat reclaim means circulates said latent heat reclaimed during said heat reclaim cycle for comfort heating of a building.

6. The system of claim 1 wherein said heat reclaim means comprises at least one refrigerant-to-air heat reclaim coil exposed to cool air which causes the refrigerant vapor to condense into the refrigerant liquid while circulating through said refrigerant-to-air heat reclaim coil and to release said latent heat which is absorbed by said refrigerant-to-air heat reclaim coil, thereby heating said cool air into heated air, thereby reclaiming said latent heat.

7. The system of claim 1 wherein said heat reclaim means comprises:

at least one indoor water-cooled condenser, connected to said heat reclaim inlet line, containing cool water for condensing the refrigerant vapor into said liquid refrigerant and thereby releasing said latent heat for absorption by said cool water for heating said cool water into heated water; and at least one water-to-air heat reclaim coil operatively connected to said water-cooled condenser, said water-to-air heat reclaim coil being exposed to cool air which causes said heated water to release said latent heat which is absorbed by said cool air through said water-to-air heat reclaim coil, thereby cooling said heated water into said cool water and heating said cool air into heated air, thereby reclaiming said latent heat.

8. The system of claim 1, further comprising a defrost pressure-regulating valve, wherein said first discharge outlet line is further operatively connected to the evaporator, said defrost pressure-regulating valve being engaged when a defrost cycle is necessary for causing the refrigerant vapor from said first discharge outlet line to circulate into the evaporator for condensing therein, thereby releasing said latent heat for defrosting the evaporator.

9. The system of claim 1, further comprising a refrigerant condensing means, operatively connected to said first discharge outlet line, to said second discharge outlet line for receiving refrigerant vapor at said second pressure level therefrom and to the evaporator, wherein the refrigerant vapor at said second pressure level is circulated within said refrigerant condensing means for condensing thereby into the refrigerant liquid for evaporating in the evaporator.

10. The system of claim 3, further comprising a double set pressure-regulating valve disposed in a conduit operatively connecting said first discharge outlet line to said heat reclaim means and to said refrigerant condensing means, said double set pressure-regulating valve being settable to a first setting for said heat reclaim cycle and to a second setting for said refrigeration cycle, wherein said double set pressure-regulating valve maintains the refrigerant vapor in said first discharge outlet line and in said conduit at said first pressure level when set to said first setting and at said second pressure level when set to said second setting.

11. The system of claim 4, further comprising:

a first suction inlet line operatively connecting said first compressor to the evaporator for receiving the refrigerant vapor;

a first discharge outlet manifold connected to said first discharge outlet line;

a second discharge outlet manifold connected to said second discharge outlet line; and a refrigerant bypass passageway connected to said second discharge outlet manifold and said first suction inlet line and having a bypass passageway pressure-regulating valve disposed therein, said refrigerant bypass passageway circulating the refrigerant vapor from said second discharge outlet manifold through said passageway and into said first suction inlet line when said pressure-regulating valve is opened during said heat reclaim cycle, thereby operatively connecting said second discharge outlet line to said first compressor.

12. The system of claim 7, further comprising at least one water pump, operatively connected to said water-cooled condenser and to said water-to air heat reclaim coil, for pumping said cool water to said water-cooled condenser, said heated water from said water-cooled condenser to said water-to-air heat reclaim coil, and said cool water from said water-to-air heat reclaim coil back to said water pump.

13. The system of claim 7, further comprising a heat reclaim outlet line connected to said water-cooled condenser through which the refrigerant liquid is discharged from said water-cooled condenser and a water-cooled condenser refrigerant pressure-regulating valve disposed in said heat reclaim outlet line, said water-cooled condenser refrigerant pressure-regulating valve maintaining said refrigerant liquid in said water-cooled condenser at sufficient pressure for providing a sufficient level of said latent heat for said absorption and thereby ensuring that said heated water is heated by said latent heat to a temperature sufficient to provide sufficient heating of said air by said latent heat in said water-to-air heat reclaim coil.

14. The system of claim 9, wherein said refrigerant condensing means condenser is an outdoor air-cooled condenser, said air-cooled condenser circulating cool outdoor air therein for said condensing.

15. The system of claim 9, wherein said refrigerant condensing means comprises an indoor glycol-cooled condenser containing cooled glycol, said indoor glycol-cooled condenser circulating said cooled glycol therein for said condensing.

16. The system of claim 9, wherein said heat reclaim means is operatively connected to said refrigerant condenser means for providing a first amount of the refrigerant liquid condensed from the refrigerant vapor in said heat reclaim means, thereby reducing said condensing required by said refrigerant condensing means for providing the refrigerant liquid to the evaporator.

17. The system of claim 10, further comprising a refrigerant liquid line for circulating the refrigerant liquid and a first bypass passageway expansion valve connecting said refrigerant liquid line and said first suction inlet line, said bypass passageway expansion valve being opened during said heat reclaim cycle to circulate a portion of the refrigerant liquid into said first suction inlet line to provide cooling in said first suction inlet line for maintaining a stable temperature therein.

18. The system of claim 10, further comprising a bypass passageway check valve disposed within said refrigerant bypass passageway for preventing refrigerant vapor at a pressure level lower than said second pressure level from circulating into said first suction inlet line during said heat reclaim cycle.

19. A method for heat reclaim in a refrigeration system having a first compressor, a second compressor, and a heat reclaim means, said method comprising the steps of:

a) during a heat reclaim cycle for said first compressor, compressing a refrigerant vapor in said first compressor to a first pressure level and in said second compressor to a second pressure level, wherein said first pressure level is greater than said second pressure level, the refrigerant vapor at said first pressure level having an increased evaporating temperature for providing increased latent heat available for reclaim from the refrigerant vapor by the heat reclaim means;

b) after said compressing, circulating the refrigerant vapor at said first pressure level to said heat reclaim means; and c) after said circulating, condensing the refrigerant vapor at first pressure level into a refrigerant liquid, thus releasing said increased latent heat which is absorbed by said heat reclaim means, thereby providing heat reclaim of said increased latent heat.

* * * * *